US006846172B2

(12) United States Patent
Vaughn et al.

(10) Patent No.: US 6,846,172 B2
(45) Date of Patent: Jan. 25, 2005

(54) EMBOSSING APPARATUS

(75) Inventors: Jeffrey Moss Vaughn, Cincinnati, OH (US); Kevin B. McNeil, Loveland, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 247 days.

(21) Appl. No.: 10/165,475

(22) Filed: Jun. 7, 2002

(65) Prior Publication Data

US 2003/0228445 A1 Dec. 11, 2003

(51) Int. Cl.[7] ..... B31F 1/07

(52) U.S. Cl. ..... 425/363; 101/6; 101/23; 156/582; 162/362

(58) Field of Search ..... 425/363, 369; 101/6, 23; 156/582; 162/362

(56) References Cited

U.S. PATENT DOCUMENTS

| | | | | | |
|---|---|---|---|---|---|
| RE27,453 | E | * | 8/1972 | Schutte et al. | 162/117 |
| 3,911,187 | A | | 10/1975 | Raley | |
| 4,211,743 | A | | 7/1980 | Nauta et al. | |
| 4,499,040 | A | * | 2/1985 | Maemoto et al. | 425/369 |
| 4,504,354 | A | | 3/1985 | George et al. | |
| 4,508,256 | A | | 4/1985 | Radel et al. | |
| 4,509,908 | A | | 4/1985 | Mullane, Jr. | |
| 4,514,345 | A | | 4/1985 | Johnson et al. | |
| 4,528,239 | A | | 7/1985 | Trokhan | |
| 4,543,142 | A | | 9/1985 | Kuepper et al. | |
| 4,759,967 | A | * | 7/1988 | Bauernfeind | 428/154 |
| 4,913,911 | A | * | 4/1990 | Wildt | 425/385 |
| 4,921,034 | A | | 5/1990 | Burgess et al. | |
| 5,098,522 | A | | 3/1992 | Smurkoski et al. | |
| 5,197,317 | A | | 3/1993 | Della Torre | |
| 5,215,617 | A | | 6/1993 | Grupe | |
| 5,245,025 | A | | 9/1993 | Trokhan et al. | |
| 5,269,983 | A | | 12/1993 | Schulz | |
| 5,294,475 | A | | 3/1994 | McNeil | |
| 5,356,364 | A | | 10/1994 | Veith et al. | |
| 5,356,506 | A | | 10/1994 | McNeil et al. | |
| 5,529,563 | A | | 6/1996 | Veith et al. | |
| 5,562,805 | A | * | 10/1996 | Kamps et al. | 162/362 |
| 5,662,758 | A | | 9/1997 | Hamilton et al. | |
| 5,686,168 | A | * | 11/1997 | Laurent et al. | 156/582 |
| 5,871,607 | A | | 2/1999 | Hamilton et al. | |
| 5,954,625 | A | * | 9/1999 | Giesler, Sr. | 493/396 |
| 5,965,235 | A | | 10/1999 | McGuire et al. | |
| 5,968,633 | A | | 10/1999 | Hamilton et al. | |
| 6,007,230 | A | | 12/1999 | Beckett et al. | |
| 6,080,276 | A | | 6/2000 | Burgess | |
| 6,099,940 | A | | 8/2000 | Hamilton et al. | |
| 6,148,496 | A | | 11/2000 | McGuire et al. | |
| 6,193,918 | B1 | | 2/2001 | McGuire et al. | |
| 6,194,062 | B1 | | 2/2001 | Hamilton et al. | |
| 6,254,965 | B1 | | 7/2001 | McGuire et al. | |
| 6,277,226 | B1 | | 8/2001 | Schulz | |
| 6,387,210 | B1 | | 5/2002 | Hsu et al. | |
| 6,733,626 | B2 | * | 5/2004 | Ruthven et al. | 162/114 |

FOREIGN PATENT DOCUMENTS

| | | | |
|---|---|---|---|
| EP | 007665 | * | 2/1980 |
| EP | 0 668 152 A1 | | 8/1995 |
| EP | 1 199 057 A1 | | 4/2002 |
| WO | WO 00/69622 | | 11/2000 |

* cited by examiner

*Primary Examiner*—James P. Mackey
(74) *Attorney, Agent, or Firm*—Peter D. Meyer

(57) ABSTRACT

Disclosed is an embossing method and material made by the method, including at least a pair of embossing rolls having unmatched embossing patterns engraved independently from each other, and having enlarged sidewall clearances between adjacent, inter-engaged protrusions and recessions of the embossing patterns. The sidewall clearances can range from about 0.002" (about 0.050 mm) to about 0.050" (about 1.27 mm). The width of the protrusions can be greater than about 0.002" or about 0.050 mm. The peripheral surface of at least one of the embossing rolls can comprise a metal, a plastic, a ceramic, or a rubber. Also disclosed is an embossed web material capable of being used as a wrap material for food products, made by the above process.

12 Claims, 15 Drawing Sheets

| | |
|---|---|
| POLYGONS / SQUARE INCH: | 550.000 |
| DENSITY RATIO: | 1.050 |
| EXCLUSION FACTOR: | .850 |
| MORTAR LINE WIDTH: | .020 |
| INTERNAL CORNER RADIUS: | .005 |

| BIN | FROM | TO | * | Percentage |
|---|---|---|---|---|
| 1 | .00029 | .00045 | 150 | 28.79079% |
| 2 | .00045 | .00064 | 203 | 38.96353% |
| 3 | .00064 | .00082 | 131 | 25.14395% |
| 4 | .00082 | .00100 | 29 | 5.56622% |
| 5 | .00100 | .00118 | 6 | 1.15163% |
| 6 | .00118 | .00128 | 2 | .38388% |

| | |
|---|---|
| 4 -Sided Polytopes | 1.727% |
| 5 -Sided Polytopes | 24.952% |
| 6 -Sided Polytopes | 51.248% |
| 7 -Sided Polytopes | 19.962% |
| 8 -Sided Polytopes | 2.111% |

| | |
|---|---|
| Polygon Area | =.30 |
| Pattern Total Area | =1.00 |
| % of area In Polygons | =29.65 |
| Final Polygon Count | =521 |
| Polygons / Square Inch | =521.00 |
| Largest Polygon Area | =.001279 |
| Smallest Polygon Area | =.000293 |

Fig. 9

| | |
|---|---|
| POLYGONS / SQUARE INCH: | 550.000 |
| DENSITY RATIO: | 1.050 |
| EXCLUSION FACTOR: | .850 |
| MORTAR LINE WIDTH: | .008 |
| INTERNAL CORNER RADIUS: | .005 |

| BIN | FROM | TO | # | Percentage |
|---|---|---|---|---|
| 1 | .00084 | .00100 | 57 | 10.94050% |
| 2 | .00100 | .00118 | 131 | 25.14395% |
| 3 | .00118 | .00136 | 149 | 28.59885% |
| 4 | .00136 | .00155 | 111 | 21.30518% |
| 5 | .00155 | .00173 | 52 | 9.98081% |
| 6 | .00173 | .00191 | 16 | 3.07102% |
| 7 | .00191 | .00209 | 3 | .57582% |
| 8 | .00209 | .00219 | 2 | .38388% |

| | |
|---|---|
| 4 -Sided Polytopes | 1.727% |
| 5 -Sided Polytopes | 24.952% |
| 6 -Sided Polytopes | 51.248% |
| 7 -Sided Polytopes | 19.962% |
| 8 -Sided Polytopes | 2.111% |

| | |
|---|---|
| Polygon Area | =.67 |
| Pattern Total Area | =1.00 |
| % of area in Polygons | =67.01 |
| Final Polygon Count | =521 |
| Polygons / Square Inch | =521.00 |
| Largest Polygon Area | =.002186 |
| Smallest Polygon Area | =.000835 |

Fig. 10

| | Width 101 | Width 126 | | Width 101 | Width 126 |
|---|---|---|---|---|---|
| Horl. Dir. 150 | 7.4 | 21.2 | Mean | 8.09 | 20.71 |
| | 8.5 | 20.5 | Std. Deviation | 0.384 | 0.251 |
| | 8.5 | 20.3 | 3* Std. Deviation | 1.153 | 0.754 |
| | 8.3 | 20.9 | | | |
| | 7.9 | 20.7 | | | |
| | 8.0 | 20.7 | | | |
| | 7.8 | 20.7 | | | |
| | 7.8 | 20.7 | | | |
| | 8.1 | 20.9 | | | |
| | 8.6 | 20.5 | | | |
| Vert. Dir. 152 | 7.9 | 21.3 | Mean | 7.73 | 20.80 |
| | 7.3 | 20.8 | Std. Deviation | 0.353 | 0.302 |
| | 7.5 | 20.4 | 3* Std. Deviation | 1.059 | 0.906 |
| | 7.5 | 20.5 | | | |
| | 7.3 | 20.7 | | | |
| | 8.0 | 20.7 | | | |
| | 7.9 | 20.9 | | | |
| | 7.5 | 20.6 | | | |
| | 8.1 | 20.8 | | | |
| | 8.3 | 21.3 | | | |
| Incl. Dir 154 | 8.6 | 20.5 | Mean | 8.14 | 20.68 |
| | 7.6 | 20.8 | Std. Deviation | 0.395 | 0.368 |
| | 7.9 | 20.7 | 3* Std. Deviation | 1.185 | 1.103 |
| | 7.8 | 20.6 | | | |
| | 8.9 | 21.6 | | | |
| | 8.2 | 20.6 | | | |
| | 8.4 | 20.2 | | | |
| | 8.1 | 20.7 | | | |
| | 8.0 | 20.4 | | | |
| | 7.9 | 20.7 | | | |
| Mean | 7.99 | 20.73 | | | |
| Std. Deviation | 0.409 | 0.304 | | | |
| 3* Std. Deviation | 1.227 | 0.912 | | | |

Fig. 12

EMBOSSING APPARATUS

FIELD OF THE INVENTION

The present invention relates to embossing methods and materials. Particularly, to embossing methods and materials produced by at least a pair of inter-engaged embossing rolls having unmatched embossing patterns separated from each other by a substantially large sidewall clearance.

BACKGROUND OF THE INVENTION

Many embossed web or sheet-type materials can be fabricated by a pair of embossing rolls, wherein each roll has an embossing pattern engraved on the peripheral surface of the roll. The rolls are inter-engaged with each other via their respective embossing patterns at a certain radial depth of engagement. The inter-engaged rolls rotate in opposite directions and impart embossing patterns on both sides of a deformable web or sheet-type material passing between the rotating embossing rolls. The web or sheet-type material becomes deflected and deformed at the points of contact with protrusions of the inter-engaged embossing patterns of the rolls, pushing the web or sheet-type material into recessions of the embossing patterns of the rolls. Upon disengagement of the protrusions and recessions, the embossed material exits the embossing rolls and retains a certain degree of the imparted deformation as a desired embossing pattern.

When the protrusions and recessions of the embossing patterns of the embossing rolls are relatively large (i.e., in the plan view of the peripheral surface of the roll), and/or when clearances between the walls of inter-engaged protrusions and recessions are relatively large, the embossing patterns on the peripheral surfaces of the rolls can be machined by any suitable machining tools, for example, mills, saws, and the like, made of tool steel, carbide or other hard materials. However, when the recessions of the embossing pattern become too small to be machined by the hard tools and/or when inter-engaged embossing patterns need to form substantially small sidewall clearances between the inter-engaged protrusions and recessions, the embossing patterns can be engraved by a laser technique, burning the recessions of the embossing pattern on the peripheral surface of a roll. Examples of the embossing rolls that are typically engraved by the laser burning technique include embossing patterns containing from about 10 to about 1,000 protrusions or recessions per a square inch area (or about 645 square mm area) of the embossing pattern.

A pair of embossing rolls can comprise "matched" or "unmatched" embossing patterns (or a combination thereof). The term "matched" embossing patterns refers herein to a pair of embossing rolls, wherein, when inter-engaged with each other, the protrusions of a first embossing roll are substantially identical in shape and dimensions with the correspondingly inter-engaged recessions of a second embossing roll, and, vice versa, the recessions of the first embossing roll are substantially identical in shape and dimensions with the correspondingly inter-engaged protrusions of the second embossing roll. The matched embossing patterns can be typically accomplished, for example, when a first embossing pattern of a first embossing roll, which has been engraved by a laser-burning technique herein above, is used as a master pattern of a master roll to chemically etch a second embossing pattern in a second embossing roll, matching the first embossing pattern of the first embossing roll.

However, when the embossing patterns need be "unmatched," (i.e., when the shape and dimensions of the protrusions of a first engraved roll are substantially not identical with that of the corresponding recessions of the second engraved roll, although the corresponding protrusions and recessions are still positioned in registry relative to each other such that they engage) the above described methods can become limited to situations wherein the unmatched parameters are relatively small. For example, a pair of inter-engaged embossing rolls can be provided with a limited side-wall clearance separating the adjacent sidewalls of the correspondingly inter-engaged protrusions and recessions by a means of coating (e.g., electroplating) the protrusions of a laser-engraved pattern of a first roll and then using the laser-engraved roll as a master roll to chemically etch the corresponding recessions of the second roll, thus producing the second pattern of the second roll that will be unmatched with the first pattern of the master roll after the coating is removed and the protrusions are reduced to the originally engraved size. The sidewall clearance achieved by the means of coating is normally limited to about 0.001" or about 0.025 mm. The limitation is due to the limited thickness of the coating that can be applied to coat the elements of the embossing pattern without deforming the desired shape of the protrusions and recessions, for example, by rounding the sharp edges of the embossing elements and the like.

Therefore, when the unmatched parameters need to be relatively greater than that which can be provided by the thickness of the coating alone, for example, when a larger sidewall clearance than that obtainable by the coating alone is needed between the inter-engaged protrusions and recessions, for example, from above 0.002" (or about 0.050 mm) to about 0.008" (about 0.203 mm) or greater such as to about 0.050" (about 1.27 mm) and/or when the shapes of the inter-engaged protrusions and recessions are substantially different from each other, the rolls can be engraved independently by a laser burning the corresponding embossing patterns on each of the embossing rolls separately.

Unfortunately, the practicalities of laser burning limit the ability to separately burn the embossing patterns of a pair of rolls that would, when brought into engagement with each other, engage uniformly over a substantially entire area of the embossing patterns. These deficiencies resulting from laser burning each of the paired embossing rolls separately from each other, are partially addressed, for example, in U.S. Pat. No. 5,356,364 (column 3, lines 39–54) with respect to another problem related to a need of obtaining a uniform contact between the protrusions and recessions "everywhere on the embossing roll". As described in the above-referenced patent, such problems sometimes can be tolerated in applications where "a sufficient and substantial number" of desired uniformed engagements between the corresponding protrusions and recessions of the inter-engaged pair of rolls is acceptable to effect an acceptable quality embossed material.

However, such problems often cannot be tolerated when "a substantial number" of uniform engagements is still not sufficient to produce a desired product. For example, when a desired sidewall clearance between the inter-engaged protrusions and recessions of the embossing rolls is not uniform throughout the entire area of the embossing rolls and there are points of engagement having insufficient clearance in order to separate the sidewall of the inter-engaged protrusions and recessions, the points of insufficient clearance can result in material production defects such as pinholes, nips, and other undesired deformities the embossed web material, which can be unacceptable in such web material products as, for example, a storage wrap material that can be used for wrapping food products and can tolerate none or only a limited number of pinholes, in order to efficiently protect the food product or any other product requiring protection from ambient environment. The term "pinhole" refers herein to a through opening in the surface of the embossed web material, having a perimeter of any shape comprising curvilinear, rectilinear or any combination thereof, wherein the minimum dimension of the through opening, measured in any direction within the plane of the web material is from about 0.003" or about 0.076 mm.

Sometimes, the above deformities resulting from the insufficient sidewall clearance can be reduced for certain material-forming instances, especially when a relatively small sidewall clearance is needed, by employing embossing rolls wherein the embossing pattern of at least one of the embossing rolls is engraved in a resilient material such as a rubber and the like, capable to yield slightly to the web, and thus, less likely to damage the web, as described in the above-referenced U.S. Pat. No. 5,356,364 column 1, lines 61–66. However, in addition to the limitation in the range of the sidewall clearance that can be used in the above method, such resilient materials are often prone to accelerated wear, and can result in undesirable production downtime, which is required to remove the worn roll and to install a new roll.

Therefore, it would be beneficial to provide an apparatus comprising at least a pair of embossing rolls having desired size sidewall clearances between the inter-engaged protrusions and recessions of the embossing rolls—such as from about 0.002" (about 0.050 mm to about 0.008" (about 0.203 mm) or greater such as to about 0.050" (about 1.27 mm)—to avoid defects in the embossed material and machine outages due to production downtime.

It would be also beneficial to provide an apparatus comprising at least a pair of embossing rolls having desired size and shape protrusions and recessions separated by desired sidewall clearances to avoid defects in the embossed material and machine outages due to production downtime.

It would be also beneficial to provide an apparatus comprising at least a pair of embossing rolls having desired size and shape protrusions and recessions separated by desired sidewall clearances, wherein the embossing rolls are capable to engage uniformly with each other over a substantially entire area of the corresponding embossing patterns.

It would be also beneficial to provide a method of producing an embossed material of the present invention, especially for products used for food storage, having sufficient barrier properties for gaseous and liquid transmission—made by the embossing rolls of the present invention—having a substantially reduced number of pinholes or defects related to the lack of the sidewall clearance.

SUMMARY OF THE INVENTION

In response to the difficulties and problems discussed above, new embossing methods and materials made by an embossing apparatus comprising at least a pair of embossing rolls have been discovered. The apparatus includes a first embossing roll having a first embossing pattern engraved on at least a portion of the peripheral surface of the first roll, the first embossing pattern comprising protrusions and recessions. The apparatus further includes a second embossing roll having a second embossing pattern engraved on at least a portion of the peripheral surface of the second embossing roll. The second embossing pattern includes protrusions and recessions, wherein the protrusions of the first embossing pattern of the first embossing roll become inter-engaged at a radial depth of engagement with the corresponding recessions of the second embossing pattern of the second embossing roll such that at least 99.7% of the inter-engaged protrusions and recessions are separated from each other by a sidewall clearance ranging from about 0.002" (about 0.050 mm) to about 0.050" (about 1.27 mm).

The protrusions of one of the embossing rolls can have a width of at least about 0.002" or about 0.050 mm. The embossing patterns of the embossing rolls can have a pattern density ranging from about 10 to about 1,000 protrusions or recessions per a 1 square inch area or about 645 mm area of the embossing pattern. The protrusions of the embossing patterns of the embossing rolls can have sidewalls angled from about 0 degrees to about 30 degrees. The peripheral surface of at least one of the embossing rolls can be a metal, a plastic, a ceramic, or a rubber. The protrusions of at least one of the embossing rolls can be continuous or discrete. The recessions of at least one of the embossing rolls can be continuous or discrete. The embossing patterns of the embossing rolls can be a regular pattern or an amorphous pattern. The apparatus can further include a third embossing roll inter-engaged with at least the first embossing roll or the second embossing roll.

Improved embossed materials, having no pinholes or very few pinholes, can be produced by the embossing methods and apparatus of the present invention. One embodiment of such a material includes a storage wrap having a plurality of spaced three-dimensional protrusions extending outwardly from the surface and separated from each other by three-dimensional spaces of recessions having a width greater than about 0.002" or about 0.050 mm. The recessions of the storage wrap are at least partially filled with an adhesive activated by a consumer when the wrap is pressed against a sealing surface. The wrap material of the present invention can have preferably no pinholes or a limited number of pinholes, not greater than a mathematical average of 0 pinholes or 6 pinholes or 12 pinholes per an area of about 72 square inches (about 46,452 square mm) of the embossed web material.

BRIEF DESCRIPTION SHOWN IN THE DRAWINGS

While the specification concludes with claims particularly pointing out and distinctly claiming the subject matter, which is regarded as the present invention, it is believed that the invention will be more fully understood from the following description taken in conjunction with the accompanying drawings, in which:

FIGS. 9 and 10 illustrate computer program charts related to a first and second amorphous embossing patterns of the first and second embossing rolls, respectively;

FIG. 12 illustrates data and statistical results of the video microscope measurements illustrated in FIG. 11;

DETAILED DESCRIPTION OF THE INVENTION

Figure 1:
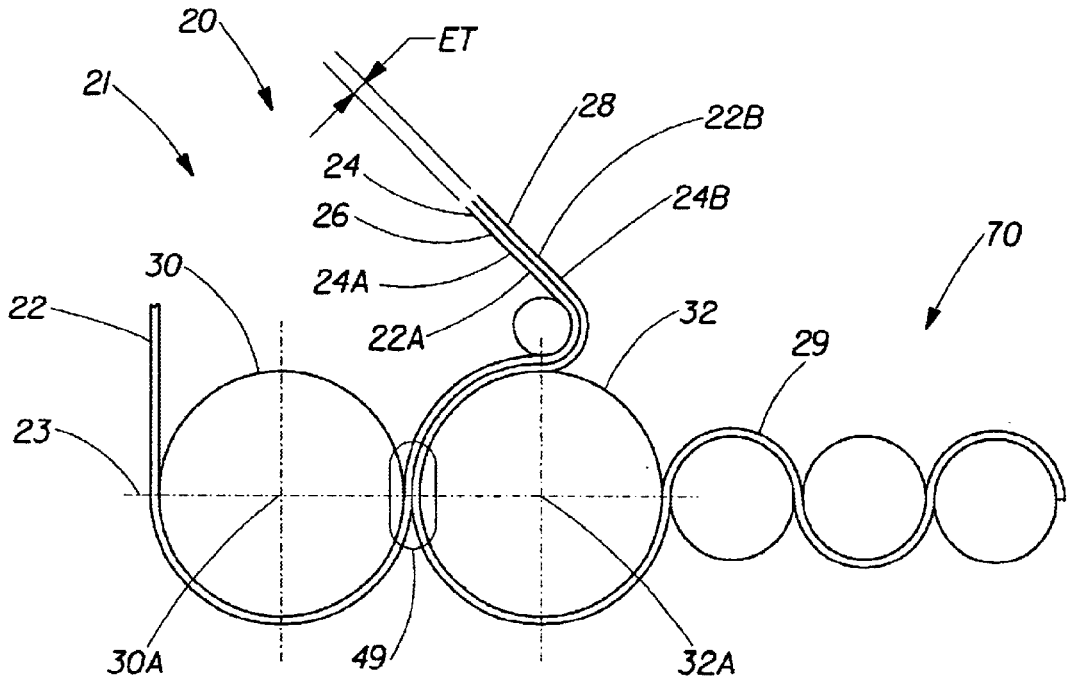
FIG. 1 is a simplified elevation view of one embodiment of a method of the present invention for producing a patterned web material formed by a pair of rotating embossing rolls of the present invention, inter-engaged at a radial depth with each other and forming a substantially non-contact relationship between corresponding protrusions and recessions of the inter-engaged rolls.

FIG. 1 is a simplified elevation view of one embodiment of a method 20 of the present invention for producing a patterned web material 24 having three-dimensional (3D) embossing patterns 26 for preferably carrying an active substance 28 such as, for example, an adhesive 29. The patterned web 24 is disclosed in the following co-assigned patents: U.S. Pat. No. 5,662,758 issued to Hamilton et al. on Sep. 2, 1997; U.S. Pat. No. 5,871,607 issued to Hamilton et al. on Feb. 16, 1999; U.S. Pat. No. 5,965,235 issued to McGuire et al. on Oct. 12, 1999; U.S. Pat. No. 6,099,940 issued to Hamilton et al. on Aug. 8, 2000; U.S. Pat. No. 6,193,918 issued to McGuire on Feb. 27, 2001; U.S. Pat. No. 6,194,062 issued to Hamilton et al. on Feb. 27, 2001; and U.S. Pat. No. 6,254,965 issued to McGuire et al. on Jul. 3, 2001, all of which are hereby incorporated by reference herein.

The patterned web 24 can be formed from a deformable web 22 by the method 20 of the present invention comprising preferably a pair 21 of rotating embossing rolls 30 and 32 of the present invention. The embossing rolls 30 and 32 have corresponding 3D patterns of protrusions and recessions engraved on the peripheral surfaces thereof. The embossing rolls 30 and 32 are inter-engaged with each other to provide preferably a multiplicity of individual engaging configurations formed by the individual corresponding protrusions and recessions of the embossing rolls 30 and 32 during the rotation thereof, wherein preferably each protrusion of the engraved embossing pattern of one of the rolls at some portion of rotation becomes inter-engaged with a corresponding recession of the opposite roll such as to form preferably a substantially non-contacting relationship between the inter-engaged corresponding protrusion and recession. The non-contacting relationship includes a full engagement position 49, when the corresponding individual protrusion and recession of the inter-engaged embossing rolls 30 and 32 become aligned with each other and with the opposing axes 30A and 32A of rotation of the embossing rolls 30 and 32, respectively.

Figure 2:
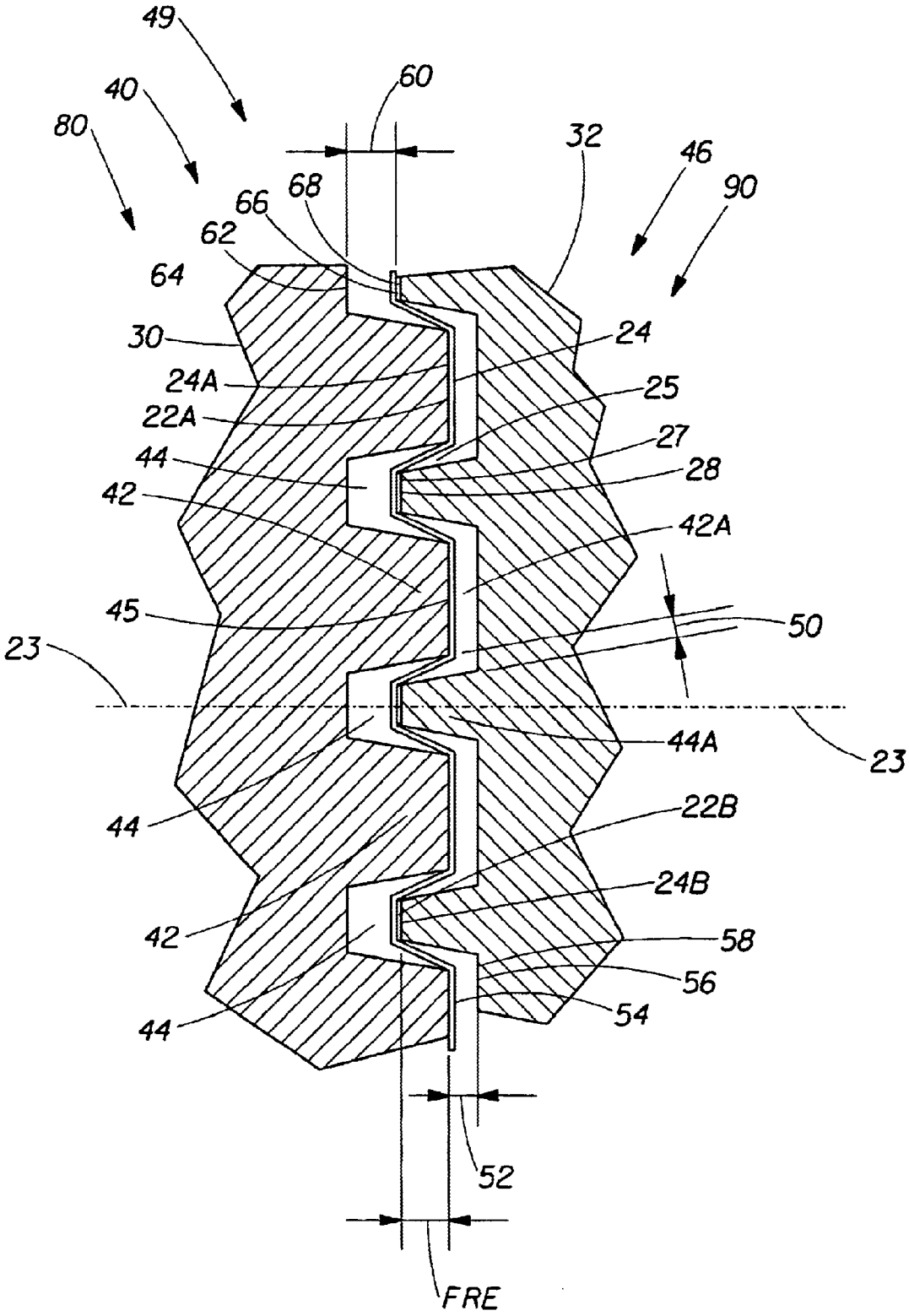
FIG. 2 illustrates an enlarged cross-sectional view of area 49 including a full engagement position formed between the inter-engaged corresponding protrusion and recession of the embossing rolls of FIG. 1.

FIG. 2 illustrates an enlarged cross-sectional view of the full engagement position 49 of FIG. 1, formed between the corresponding protrusion and recession of embossing rolls 30 and 32, taken along a centerline line 23 extending between the axes of rotation 30A and 32A of the respective embossing rolls 30 and 32, when the inter-engaged corresponding protrusion and recession become aligned with each other along the centerline 23 in order to form the embossed web 24. The full engagement position 49 includes desired clearance(s), sufficient to accommodate the desired thickness of the deformable web material 22 to be embossed between the inter-engaged protrusions and recessions of the rotating embossing rolls 30 and 32.

The first embossing roll 30 has a first embossing pattern 40 engraved on the peripheral surface thereof, comprising protrusions 42 and recessions 44. The second embossing roll 32 has a second embossing pattern 46 engraved on the peripheral surface thereof, comprising recessions 42A and protrusions 44A. The protrusions 42 of the first embossing roll 30 engage with the corresponding recessions 42A of the second embossing roll 32, and similarly, the recessions 44 of the first embossing roll 30 engage with the corresponding protrusions 44A of the second embossing roll 32 roll. Corresponding protrusions and recessions which become inter-engaged with each other to form the full engagement position 49 and a resulting embossment of a deformable web 22 in accordance with the present invention, are preferably inter-engaged such that they are separated from each other by desired clearance(s) therebetween, such as sidewall clearances and radial clearances. For instance, a sidewall clearance 50 can be formed between the sidewalls of the corresponding inter-engaged protrusions and recessions. Further, a first radial clearance 52 can be formed between the top surface 45 of the protrusions 42 of the first embossing roll 30, defining an outermost peripheral surface 54 of the first roll 30, and the bottom surface 56 of the corresponding recessions 42A of the second embossing roll 32, defining an innermost peripheral surface 58 of the second embossing roll 32. Similarly, a second radial clearance 60 can be formed between the bottom surface 62 of the recessions 44 of the first embossing roll 30, defining the innermost peripheral surface 64 of the first embossing roll 30, and the top surface 66 of the corresponding protrusions 44A of the second embossing roll 32, defining the outermost peripheral surface 68 of the second embossing roll 32.

As disclosed hereinabove, the patterned web 24 can be formed from any suitable deformable material 22, provided as a web or a sheet, by the deformation thereof into a three-dimensional pattern 26, by passing the deformable material 22 through a pair 21 of embossing rolls 30 and 32, of the present invention, inter-engaged with each other to form a full engagement position 49 between the corresponding protrusions and recessions comprising the peripheral surfaces of the rolls 30 and 32.

The embossing rolls 30 and 32 of the present invention can have any desirable temperature to facilitate the deformation of the deformable material 22 between the interengaged protrusions and recessions. Also, the embossing rolls 30 and 32 can have any desired dimensions, such as a diameter and length, to accommodate a particular production scale and to provide the desired roll strength capable to withstand the deformation forces to which the embossing rolls 30 and 32 can be subjected during the production of the embossed web 24. In one embodiment of the present invention, represented in the example below, the embossing rolls have an outside diameter of about 24.00" or about 610 mm and the width of the embossing pattern, extending along the length of the embossing roll, of about 26.00" or about 660 mm. The peripheral surface of the embossing rolls can be a metal, a plastic (e.g., EBONITE), a ceramic, a rubber, or any other suitable material.

Referring to FIGS. 1 and 2, the active substance 28 can be any material capable of being held in preferably open valleys 25 of the three-dimensional structure 26 of the embossed web 24. For depositing the active substance 28 into the valleys 25, the active substance 28 can be first deposited onto the top surface 66 of the protrusions 44 (defining the outermost peripheral surface 68) of the second embossing roll 32 forming the open valleys 25 of the patterned web 24. The active substance 28 can be deposited by any suitable means providing preferably a uniform deposition layer of the adhesive 29 on the outermost peripheral surface 68 of the second embossing roll 32. In one embodiment of the present invention, the active substance 28 can be deposited by a series of transfer rolls 70 that can comprise any number of transfer rolls to provide the desired uniformity of the coverage. However, it should be noted that the active substance 28 could be deposited onto the outermost peripheral surface 68 as a non-uniform layer having any desirable thickness profile.

Figure 1A:
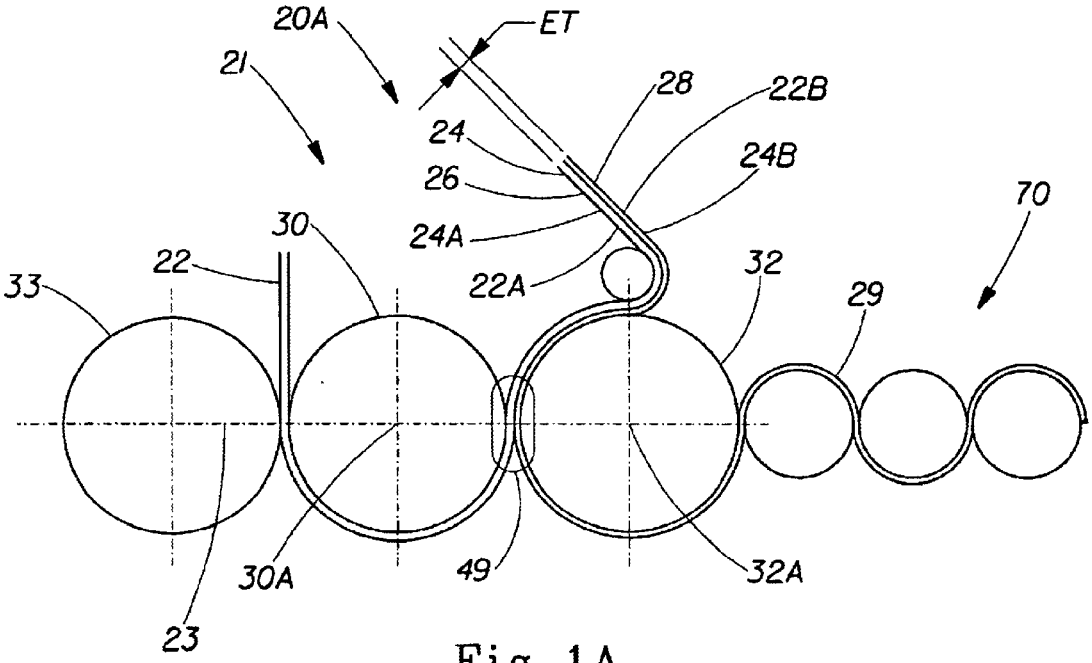
FIG. 1A is a simplified elevation view of one embodiment of a method of the present invention for producing a patterned web material formed by more than two rolls.

Alternatively to the embodiment 20 of the method of the present invention shown in FIG. 1, FIG. 1A illustrates another embodiment 20A, employing three rolls of the present invention, wherein the embossing of the web takes place between the rolls 30 and 33, and the transfer of the active substance 28 from the roll 32 into the recessions on the web 24 takes place between the rolls 30 and 32.

After forming the patterned web 24, it can be removed from the apparatus 20 or 20A—by any suitable means—for further handling, for example, for packaging as a wound roll. When wound on rolls, it is desirable to prevent nesting of adjacent layers of the patterned web 24, when protrusions in overlaying layers of the patterned web 24 interlock with one another due to their size, shape, location, and/or geometrical arrangement. Nesting of adjacent layers of a continuous three-dimensional web can create difficulty in unrolling the end of the web. This difficulty can be even greater when the three-dimensional web is utilized as a carrier for an active substance such as, for example, an adhesive, resulting in premature adhesion and/or contamination of the active substance. Therefore, in order to resist nesting, the pattern of the three-dimensional web can have an amorphous pattern of three-dimensional shapes, for example, polygons, having a statistically controlled degree of randomness, as is disclosed in the following co-assigned patents: U.S. Pat. No. 5,965,235 issued to McGuire et al. on Oct. 12, 1999; U.S. Pat. No. 6,099,940 issued to Hamilton et al. on Aug. 8, 2000; U.S. Pat. No. 6,193,918 issued to McGuire on Feb. 27, 2001; U.S. Pat. No. 6,194,062 issued to Hamilton et al. on Feb. 27, 2001; and U.S. Pat. No. 6,254,965 issued to McGuire et al. on Jul. 3, 2001, all of which are hereby incorporated by reference herein. (The term "amorphous" refers herein to an embossing pattern exhibiting no readily perceptible organization, regularity, or orientation of constituent elements, as opposed to the term "regular," which refers herein to an embossing pattern that does exhibit readily perceptible organization, regularity, or orientation of constituent elements).

The above-referenced patents disclose possible variations of embossing patterns, including protrusions formed from any three-dimensional shape, but preferably of a convex polygonal shape of substantially equal height frustums having convex polygonal bases in the plane of one surface of the material and having interlocking, adjacent parallel sidewalls. As used herein, the term "polygon" (and the adjective form "polygonal") is utilized to refer to a two-dimensional geometric figure with three or more sides, since a polygon with one or two sides would define a line. Accordingly, triangles, quadrilaterals, pentagons, hexagons, etc. are included within the term "polygon," as would curvilinear shapes such as circles, ellipses, etc. which would have an infinite number of sides.

When designing a three-dimensional web material structure, the desired physical properties of the resulting structure will dictate the size, geometrical shape and spacing of the three-dimensional topographical features as well as the choice of materials. Further, a web material can be intentionally created with a plurality of amorphous areas within the same web, even to the point of replication of the same amorphous pattern in two or more such regions. For example, an amorphous pattern can be repeated in the machine, or the winding, direction at an interval larger than the greatest expected circumference of a wound roll of the patterned web 24, thereby preventing nesting of the patterned web 24 in the wound roll. Further, the designer may purposely separate regions of amorphous patterns, the regions of regular (i.e., non-amorphous) patterns, or even "blank" regions with no protrusions at all, or any combination thereof. These and other variations of the embossing patterns are disclosed in the patents incorporated by reference hereinabove.

Referring to FIGS. 1 and 2, the three-dimensional structure 26 that can be embossed on the patterned web 24 of the present invention, is preferably designed to have substantially amorphous patterns comprising a multiplicity of protrusions and recessions shaped as polygons having various sizes and shapes and forming a first amorphous pattern 24A on a first side 22A of the deformable web 22, and a second amorphous pattern 24B on the second side 22B of the deformable web 22.

In order to emboss the amorphous patterns 24A and 24B on the deformable web 22 to form the embossed web 24, the embossing rolls 30 and 32 also have respective amorphous patterns engraved on the peripheral surfaces thereof. The rolls 30 and 32 are positioned to engage with each other to form a rotational relationship, wherein the first embossing roll 30 comprises a first amorphous pattern 80 engraved on the peripheral surface of the first embossing roll 30 to form the first amorphous pattern 24A on a first side 22A of the web 22, and the second embossing roll 32 comprises a second amorphous pattern 90 engraved on the peripheral surface of the second embossing roll 32 to form a second amorphous pattern 24B on the second side 22B of the web 22.

Figure 3:
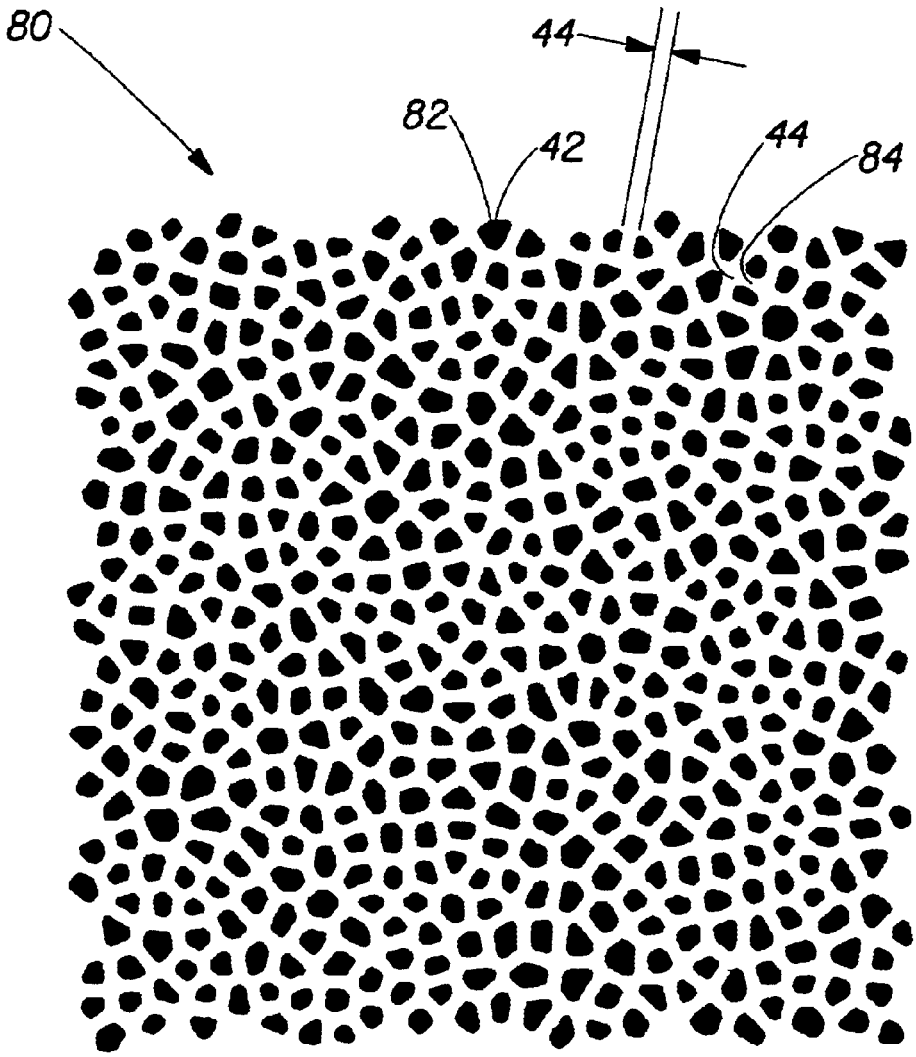
FIG. 3 is an enlarged plan image of one embodiment of a 1 square inch area (about 645 square mm) of a first engraved pattern of the first embossing roll shown in FIGS. 1 and 2.
Figure 4:
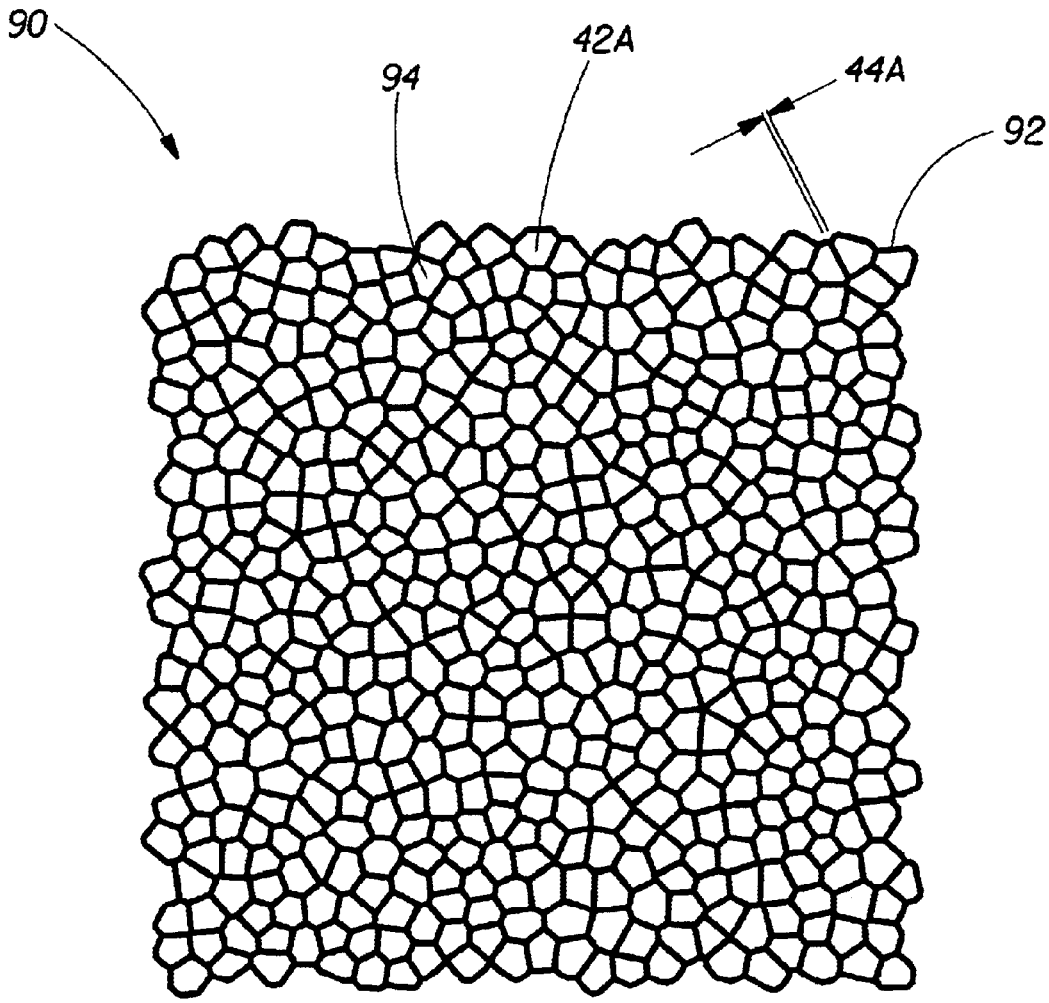
FIG. 4 is an enlarged plan image of one embodiment of a 1 square inch area (about 645 square mm) of a second engraved pattern of a second embossing roll shown in FIGS. 1 and 2.

FIGS. 3 and 4 illustrate enlarged, plan views of one embodiment of a 1 square inch area (about 645 square mm) of the amorphous embossing patterns 80 and 90 of the embossing rolls 30 and 32, respectively. The first amorphous pattern 80 of the first embossing roll 30 comprises protrusions 42 shown as various size and shape protruding polygons 82 (presented in this example in solid black), separated by recessions 44 shown as white spaces 84. Similarly, the second amorphous pattern 90 of the second embossing roll 32 comprises recessions 42A shown as various size and shape recessing polygons 94 shown in white and separated by the thickness of the protrusions 44A represented by the thickness of the black lines 92 enclosing the recessing polygons 94. The sides of the adjacent polygons of both patterns described herein are preferably parallel to each other, although, any other suitable relative orientations between the adjacent polygons can be selectively utilized.

Figure 5:
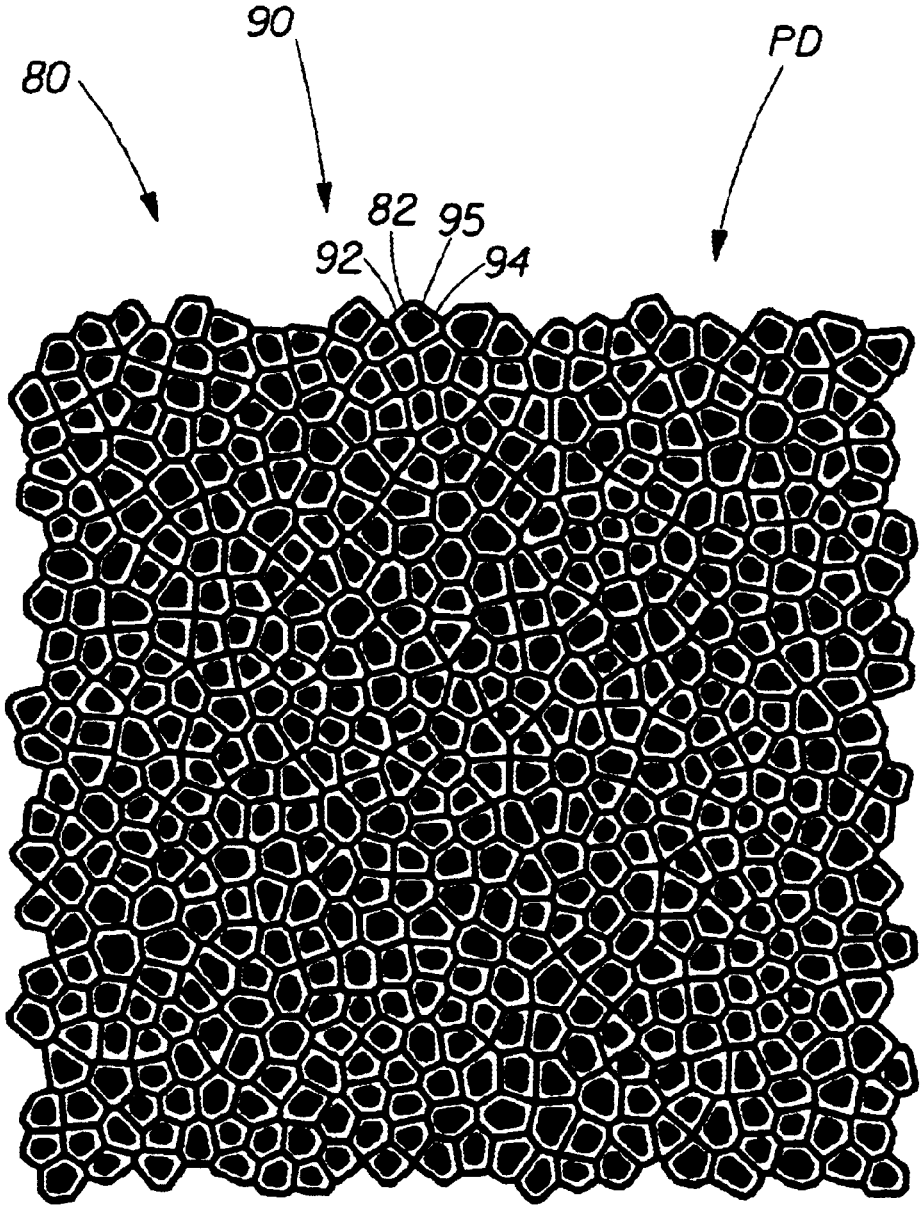
FIG. 5 illustrates an enlarged plan image resulting from superimposing the plan images of the engraved patterns of FIGS. 3 and 4, forming a multiplicity of plan images of individually inter-engaged protrusions and recessions substantially separated from each other by sidewall clearances.

FIG. 5 illustrates enlarged plan images of the amorphous patterns 80 and 90 of FIGS. 3 and 4, superimposed on each other to form a multiplicity of engagements between the superimposed images of the corresponding protrusions and recessions, where the protruding polygons 82 fit into recessing polygons 94 and are separated from the side walls of the recessing polygons 94 by a desired sidewall clearance 95 (shown as white spaces between the protruding polygons 82 and black lines 92 representing the side walls of the recessing polygons 94).

EXAMPLE

This example provides an exemplary method of providing one embodiment of the apparatus of the present invention for producing one embodiment of an embossed web material of the present invention such as a wrap material for wrapping a food product. The wrap material of the present invention must have preferably no pinholes or at least not more than about 12 pinholes per a material product size of about 72 square inches, in order to provide an effective protection of the wrapped food product.

The wrap material of the present invention was formed from a relatively thin deformable film, and, thus can require a relatively small sidewall clearance—usually from about 0.002" (about 0.050 mm) to about 0.008" (about 0.203 mm)—between the unmatched embossing patterns of the embossing rolls forming the embossed web. However, it should be noted that the present example is intended to also represent other instances where the embossed material can be relatively thick, including films or, in particular, disposable tissue and towel materials—wherein a single-ply material can be about 0.012" (about 0.30 mm) thick and a two-ply material can be about 0.025" (about 0.64 mm) thick—, and, thus, require the use of generally greater sidewall clearances such as up to 0.050" (1.27 mm) or even greater.

The apparatus of the present example includes at least two embossing rolls which can inter-engage with each other to form a substantially non-contact relationship between the inter-engaged rolls, wherein the corresponding protrusions and recessions of the inter-engaged embossing patterns have desired cross-sectional profiles and are separated from each other by desired clearances, including a sidewall clearance that is suitable to prevent the deformable web material 22 from becoming pinched or otherwise damaged by the lack of a sufficient clearance between the inter-engaged protrusions and recessions imparting the embossing pattern on the deformable web material 22. (However, please note again that the number of the embossing rolls of the present invention can be greater than two, and it can include any number of rolls, for example, three, four, or more.)

Embossed Web

Referring to FIGS. 1 and 2, the embossed web 24 of the present example, was intended to be used as a storage wrap material providing containment and protection of various items, as well as preservation perishable materials such as food items. The embossed web comprises an active side including an adhesive or adhesive-like substance exhibiting an adhesion peel force when the storage wrap material is activated by a user, preferably by applying an external compressive force exerted in a direction substantially normal to the wrap material.

The embossed web 24 was formed by imparting embossing patterns on the deformable web material 22, which, in the present example, was a high-density polyethylene film (HDPE) of about 0.0005" (about 0.013 mm) thick, available, for example, under brand name Paxon HDPE from Exxon Mobil Chemical for use in food storage applications. The film has an oxygen permeability of 5,580 cc/24 hr×100 meter squared×mil, tested in accordance with ASTM D-1434; and a water vapor transmission rate of 11.6 g/24 hr×100 meter squared×mil, tested in accordance with ASTM E-969.

The embossed web 24 had an embossed thickness ET, which was about 0.004" (about 0.102 mm), although any other suitable thickness could have been selected. One side of the embossed web 24 included preferably continuous valleys 25, carrying a thin layer 27 of an active substance 28, which, in the present example, was a thin layer of an adhesive selected from the various suitable active substances disclosed herein above.

In the cross-section, as shown in FIG. 2, the adhesive layer 27 was selected to be of about 0.001" (about 0.025 mm) thick and about 0.008" (about 0.203 mm) wide. Further, it was selected for the adhesive layer 27 to extend coterminously and continuously with the continuous valleys 25, to ensure a continuous seal between the adhesive layer 27 and the surface against which the adhesive layer 27 can be pressed during the consumer use of the product which comprises the embossed web 24. (However, note that any other desired cross-sectional dimensions of the adhesive layer 27 can be alternatively selected, as well as any length of the adhesive layer 27, which can be continuous or discontinuous.)

The width of the valleys 25 was selected to correspond with the desired width of the adhesive layer 27, i.e., about 0.008" (about 0.203 mm). However, the width of the valley can be any width smaller than the 0.008" of the present example, and limited, in the present invention, by the integrity of a particular material carrying the embossing pattern of an embossing roll forming the valleys 25—as low as about 0.002" (about 0.050 mm) or less. Further, the width of the valleys 25 can be greater than the 0.008" of the present example, generally, without limitation. However, the present invention is concerned with the width of the valleys 25 within about 0.002" (about 0.050 mm) to about 0.050" (about 1.27 mm), the range that is not generally achievable by a hard tool engraving of the embossing pattern.

Further, the embossing patterns of the present example, form amorphous patterns comprised of various size and shape polygons, in order to prevent the undesired web nesting phenomena when the embossed web is wound into a roll, as was described herein above.

It was experimentally discovered that the embossed web 24 of the present example, when used as a wrap material sealed to a surface, can provide a sufficient sealing function with the surface when the embossed web 24 has no pinholes or at least no more than a mathematical average of 12 pinholes per an area of about 72 square inches or about 46,452 square mm thereof, and further when the area of the recession network—filled with a layer of adhesive—comprises from about 30% to about 70% of the area of the first embossed pattern the first side thereof, and also when the pattern density PD (see FIG. 5) comprises from about 500 to about 700 polygons per a 1 square inch (about 645 square mm) area of the first embossed pattern the first side thereof. (Again, as was disclosed herein above, the pattern density PD can vary generally from 10 to 1,000 embossing elements, depending on certain needs.)

Embossing Rolls

Each of the embossing rolls 30 and 32 of the present invention is selected to have an outer diameter of about 24.00" (about 610 mm) and an embossing pattern width (extending in the cross-machine direction, CMD) of about 26.00" (about 660 mm).

Referring to FIG. 2, illustrating an enlarged cross-sectional view of the protrusion 44A of the second embossing roll 32, functioning, in the present example, as an embossing member for forming the valley 25 and also for depositing the adhesive layer 27 into the formed valley 25. FIG. 2 also shows the recession 44 of the first embossing roll 30, inter-engaged with the protrusion 44A at a point of rotation of the embossing rolls 30 and 32, when the protrusion 44A and the recession 44 are fully inter-engaged and aligned with each other in a full engagement position 49. The protrusion 44A and the corresponding recession 44, both have desired cross-sectional profiles, which during the engagement are separated from each other by desired clearances, sufficient to prevent pinching and other undesired damages of the embossed web.

Referring to FIGS. 1 and 2, it has been experimentally discovered that in order to provide the desired embossed thickness ET of about 0.004" (0.102 mm) of the embossed web 24 of the present invention, the embossing rolls 30 and 32 need to be inter-engaged with each other at a full radial engagement FRE of about 0.009" (about 0.229 mm). It should be noted, that the full radial engagement FRE can vary—depending on particular needs—and can extend beyond the preferred range of the FRE of the present invention which is from about 0.005" (about 0.127 mm) to about 0.010" (about 0.254 mm).

Figure 6:
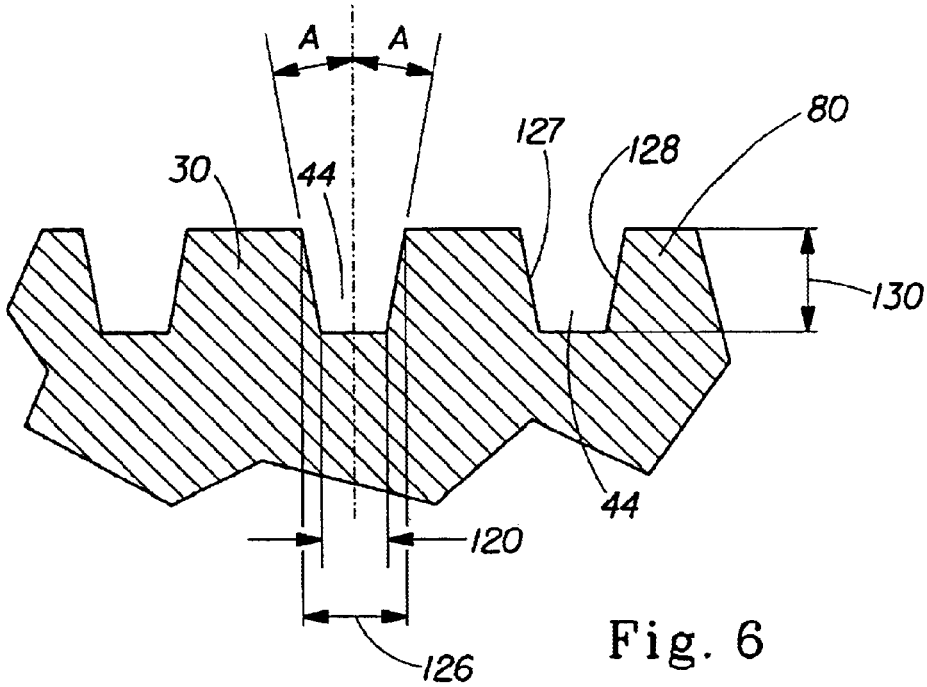
FIG. 6 is an enlarged cross-sectional view of the protrusion of the first engraved pattern of the first embossing roll of FIG. 2.
Figure 7:
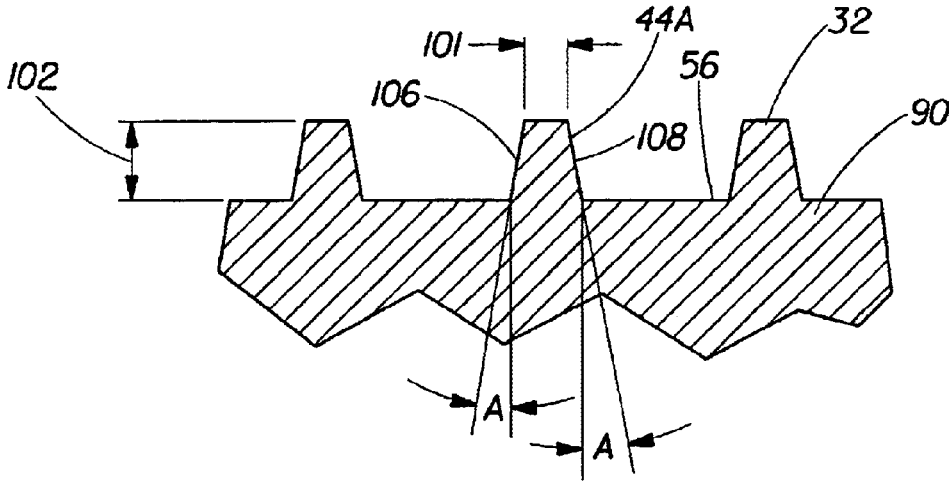
FIG. 7 is an enlarged cross-sectional view of the recession, corresponding with the protrusion of FIG. 6, of the second engraved pattern of the second embossing roll FIG. 2.
Figure 8:
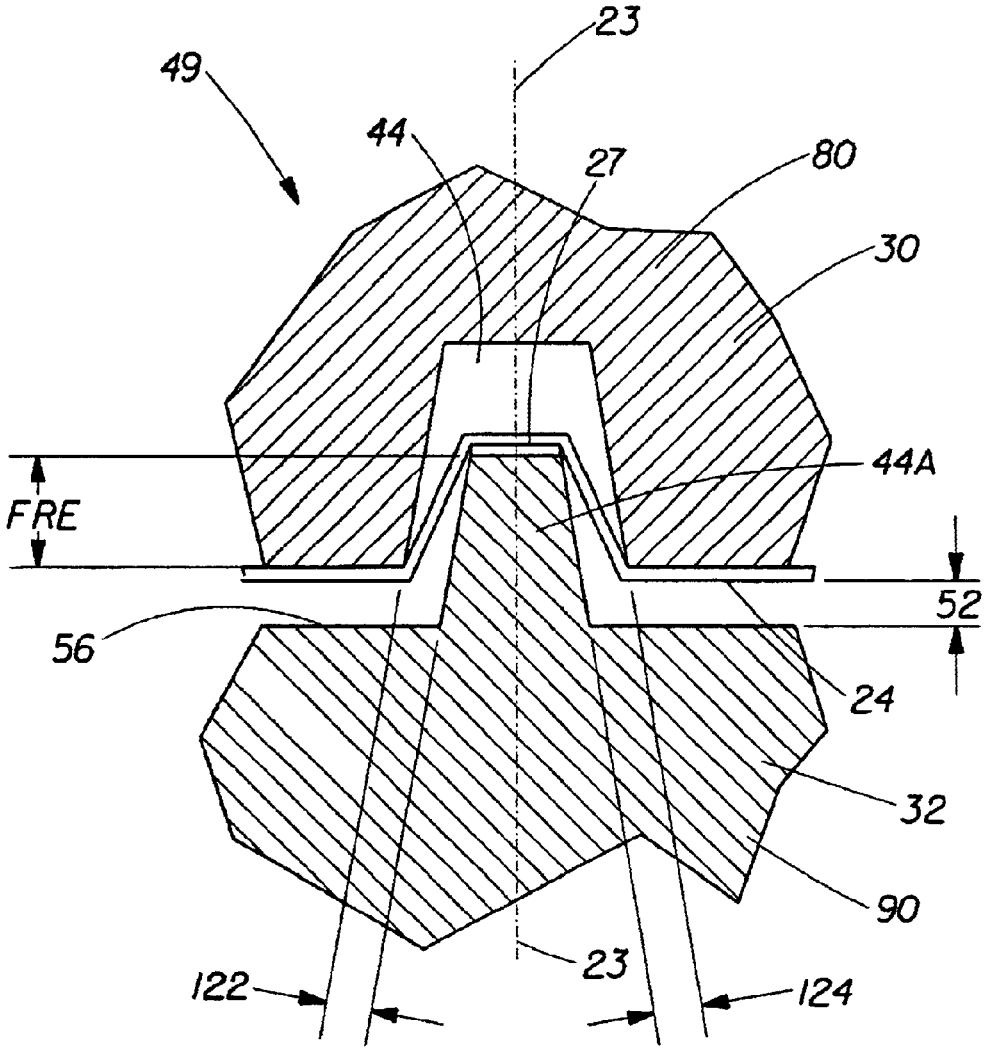
FIG. 8 is an enlarged cross-sectional view of the protrusion of FIG. 6 and the recession of FIG. 7 in a full engagement position aligned with centerline 23 extending between the axes of the rotation of the embossing pair of rolls.

FIGS. 6 and 7, for the clarity of the pictures, show separately the enlarged portions of the rolls 30 and 32 of FIG. 2, wherein, FIG. 6 shows the enlarged recessions 44 of the first embossing roll 30 and FIG. 7 shows the enlarged protrusions 44A of the second embossing roll 32 forming the valleys. FIG. 8, for the clarity of the picture, shows the enlarged full engagement position 49 of the protrusion 44A and the recession 44.

Referring to FIGS. 7 and 8, the cross-sectional configuration of the protrusion 44A, forming the valley 25, can be defined by the width 101, the height 102, and the contour of the sidewalls 106 and 108 connecting the width 101 with the bottom surface 104.

The width 101 of the protrusion 44A forming the valley 25 of the embossed web material 24 of the present example, was selected to correspond with the desired width of the adhesive layer 27 and the valley 25, i.e., about 0.008" (about 0.203 mm). However, the width 101 of the protrusion 44A can be any width smaller than the 0.008" width of the present example, and limited, in the present invention, by the integrity of a particular material carrying the embossing pattern of an embossing roll forming the valleys 25—as low as about 0.002" (about 0.050 mm) or less. Further, the width 101 of the protrusion 44A can be greater than the about 0.008" of the present example, generally, without limitation. However, the present invention is concerned with the width 101 of the protrusion 44A within about 0.002" (about 0.050 mm) to about 0.050" (about 1.27 mm), the range that is not generally achievable by a hard tool, engraving the embossing pattern.

The height 102 of the protrusion 44A was selected to be about 0.015" (about 0.381 mm), which at the full radial engagement FRE of about 0.009" (about 0.229 mm) described herein above, provided a sufficient first radial clearance 52 (FIGS. 2 and 8) of about 0.006" (0.152 mm) between the web 24 and the bottom surface 56, to prevent damage to the web 24 by contacting the bottom surface 56.

The contour of the side walls 106 and 108 of the protrusion 101 can be any suitable contour such as curvilinear (including convex, concave, or combinations thereof), rectilinear (including a substantially perpendicular disposition of the side walls 106 and 108, or an inclined, sloped disposition at any angle A ranging from about 0 degrees to about 30 degrees. In the present example, the contour of the protrusion 44A was selected to be rectilinear with an angle A of about 10 degrees.

Referring to FIGS. 6 and 8, the corresponding recession 44 of the first embossing roll 30, inter-engaged with the protrusion 44A of the second embossing roll 32, as also shown in FIG. 2, can be designed in relation to the above selected shape and dimensions of the protrusion 44A, desired first radial clearance 52, and sidewall clearances 122 and 124. If, for example, the first radial clearance 52 is selected to be about 0.006" (0.152 mm) and the side wall clearances 122 and 124 are selected to be about 0.004" (about 0.107 mm), then the width 120 of the recession 44 can be about 0.013" (about 0.330 mm), the width 126 can be about 0.020" (0.508 mm), the side walls 127 and 128 can be inclined at the angle A of about 10 degrees, and the depth 130 of the recession 44 can be about 0.020" (about 0.508 mm). (It should be noted that the sidewall clearance can range from about 0.002" or 0.050 mm to about 0.008" or about 0.203 mm or greater, if desired.) Referring to FIGS. 7 and 8, when the width 101 of the protrusion 44A of the second embossing roll 32 is selected to be about 0.008" or about 0.203 mm, a suitable amorphous pattern of recessions 44, shaped as various size and shape polygons, separated by the continuously extending width 101, can be selected by the use of a suitable commercial, random pattern generating program such as HARQ70A.exe, developed for the Procter & Gamble Company by Stress Engineering Services of Cincinnati Ohio (www.stresseng.com).

By inputting into the above computer program the desired width 101 of the protrusions 44A and then, separately, the desired width 126 of the recessions 44 (among with a few other inputting parameters), two separate 2-dimensional amorphous patterns 80 and 90 (illustrated in FIGS. 3 and 4) of the embossing rolls 30 and 32, respectively, can be created.

For the first embossing pattern 80, the above program provides a chart, as shown in FIG. 9, displaying some of the information of the pattern 80 of the first embossing roll 30, having the width 126 of about 0.020" (about 0.508 mm), which was inputted under a name "mortar line width" along with other four inputs, including the target number 550 of the polygons per 1 square inch area (about 645 square mm). The chart shows some of the data provided by the program, including the smallest polygon area of about 0.000293 square inch (about 0.189 square mm), which, for the present example, is sufficient in size to prevent penetration of the polygon through the deformable material 22 during the formation of the embossed web 24. The final polygon count or the final pattern density is listed as 521 polygons per a 1 square inch area, which is also within the specified pattern density range of about 500 to about 700 polygons.

Similarly to the first pattern 80 of the first roll 30 above, the corresponding second pattern 90 of the second roll 32 can be selected by inputting the width 101 (0.008" or 0.203 mm) of the protrusion 44A of the second embossing roll 32 in the program HARQ70A.exe above, instead of the width 126 of the first embossing roll 30 inputted earlier. The resulting chart is shown in FIG. 10. Both programs of the respective first and second patterns 80 and 90 are created in post-script electronic files defining the 2D configurations of the respective first and the second patterns 80 and 90.

After the post-script files of the 2D patterns 80 and 90 are selected, these files can be used to create respective machining files for engraving the embossing rolls by laser-burning the respective 3D patterns on the respective peripheral surfaces of the embossing rolls. The machining files can be often developed experimentally for specific parameters of the laser-burning process, such as, for example, for a specific material of the peripheral surface of the roll to be burned by the laser, a specific power of the laser and how it changes during a specific advancing speed of the laser, a specific speed of rotation of the roll during the laser burning, a specific configuration of the side wall of the protrusion and recession, and the like.

These machining files for laser-burning the first embossing roll 30 and the second embossing roll 32 can be created separately by test-burning a relatively small area (e.g., 1 square inch or 645 square mm) of the respective patterns on each of the respective peripheral surfaces of the rolls 30 and 32, preferably outside of the boundaries of the intended full patterns to be burned later after inspecting each of the test-burning areas separately.

The inspection methods can include techniques for inspecting each of the patterns in the 2D and the 3D formats. The 2D format is defined by the outermost peripheral surface of the roll bearing the plane image of the engraved pattern and directed to inspecting the plane dimensions and configurations of the elements of the engraved pattern. The 3D format is directed to inspecting cross-sectional configurations of the elements of the engraved pattern.

2D Inspection

Figure 11A:
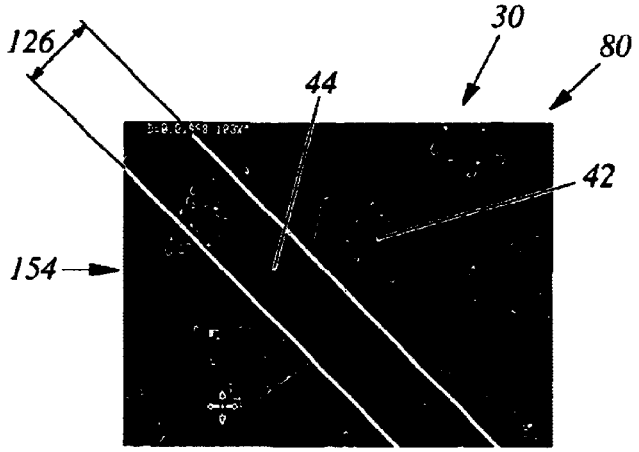
FIG. 11 is a video microscope image of the first embossing pattern of the first embossing roll of the present invention.
Figure 11B:
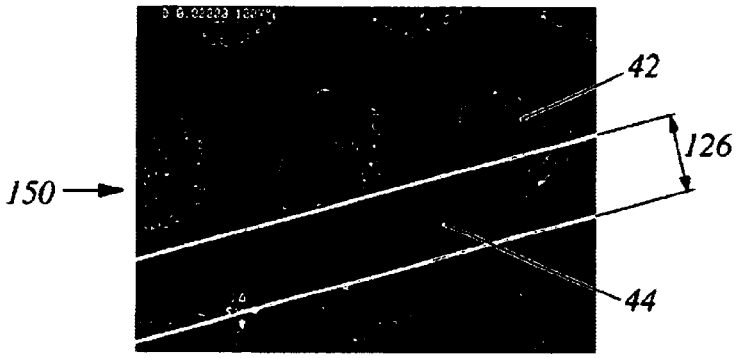
Figure 11C:
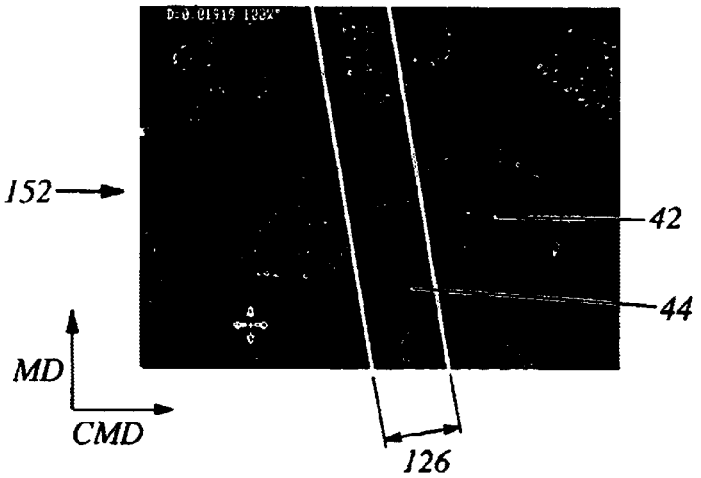

The 2D inspection can include any suitable video microscope providing preferably about 100× magnification (although any other suitable magnification can be used) and including a suitable measuring device. FIG. 11 illustrates an exemplary image of a 100× magnification of a fragment of the engraved embossing pattern 80 on the outermost peripheral surface 54 of the first roll 30 under a video microscope. The measuring device is indicated by the parallel white lines, measuring desired elements of the pattern, for example, the width 126 of the recessions 44 between the protruding polygons 42 of the first roll 30.

FIG. 12 shows exemplary data collected from measuring both the width 101 of protrusions 44A (of the second embossing pattern 90 of second embossing roll 32) and the width 126 of recessions 44 (of the first embossing pattern 80 of first embossing roll 30) in three directions, identified as a horizontal direction 150, a vertical direction 152, and an inclined direction 154. Referring to FIG. 12, the terms "vertical direction" or "horizontal direction" include any direction disposed within plus/minus 30 degrees from a machine direction (indicated by an arrow MD) or a cross-machine direction (indicated by an arrow CMD), respectively. The term "inclined direction" includes any direction disposed within plus/minus 15 degrees from a 45-degree direction taken in relation to the MD or CD directions. FIG. 12 also shows the statistical data including mean and standard deviation.

3D Inspection

The 3D inspection can include taking impressions of protrusions and/or recessions by use of any suitable plastic material capable to conform to the inspected shape at an applied pressure and to retain the conformed shape after the pressure is ceased and the impression is separated from the impressed element of the pattern. Suitable plastic materials can include, for example, silicone.

After removing the silicon impression from the impressed area of the pattern, the silicon impression is cut preferably substantially perpendicular across the sidewall thereof, that corresponds with a respective sidewall of the impressed protrusion or recession, in order to create a cross-sectional impression defining the contour of the impressed protrusion or recession. The cross-sectional impressions can provide desired data with respect to size and shape of protrusions and/or recessions. The cross-sectional impressions can be identified in relation to the three directions of measurements,—vertical, horizontal, and inclined,—described and defined hereinabove in relation to the video microscope testing.

Figure 13:
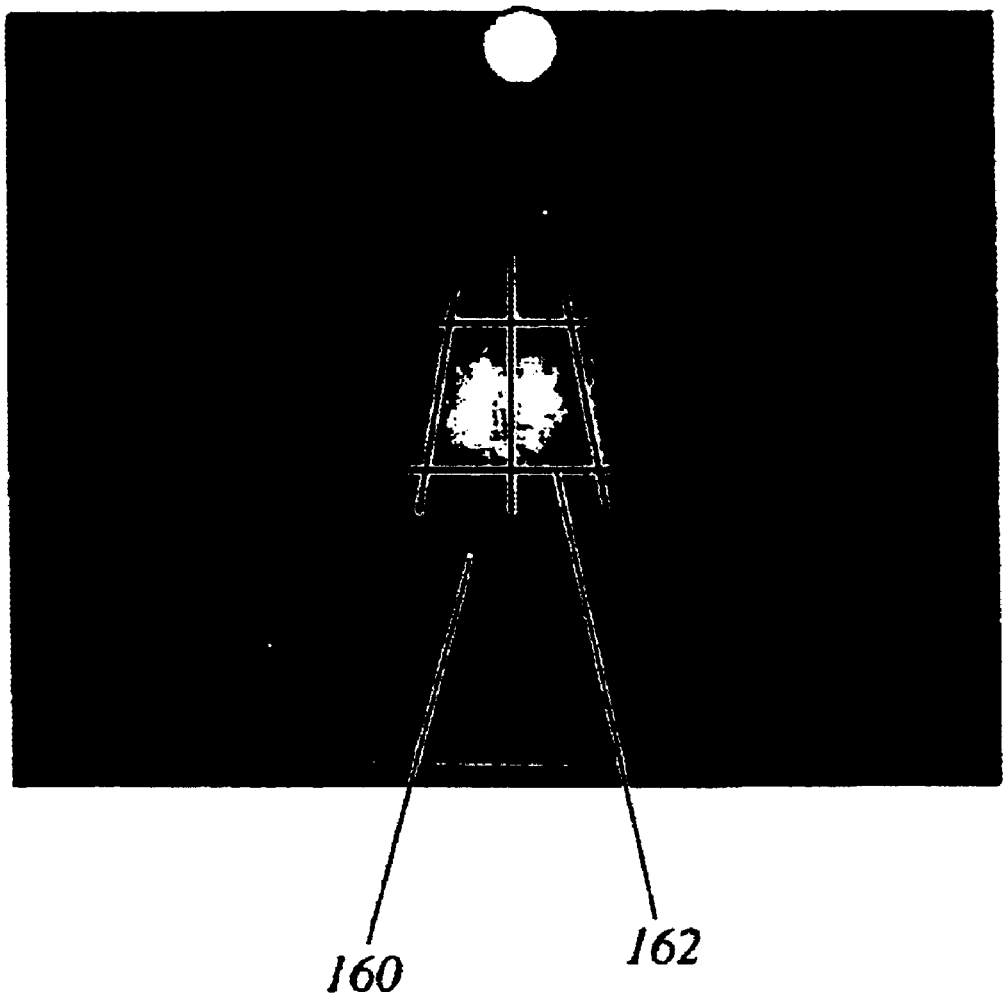
FIG. 13 illustrates a visual comparison between a cross-sectional impression and template, disposed against a light source.
Figure 14:
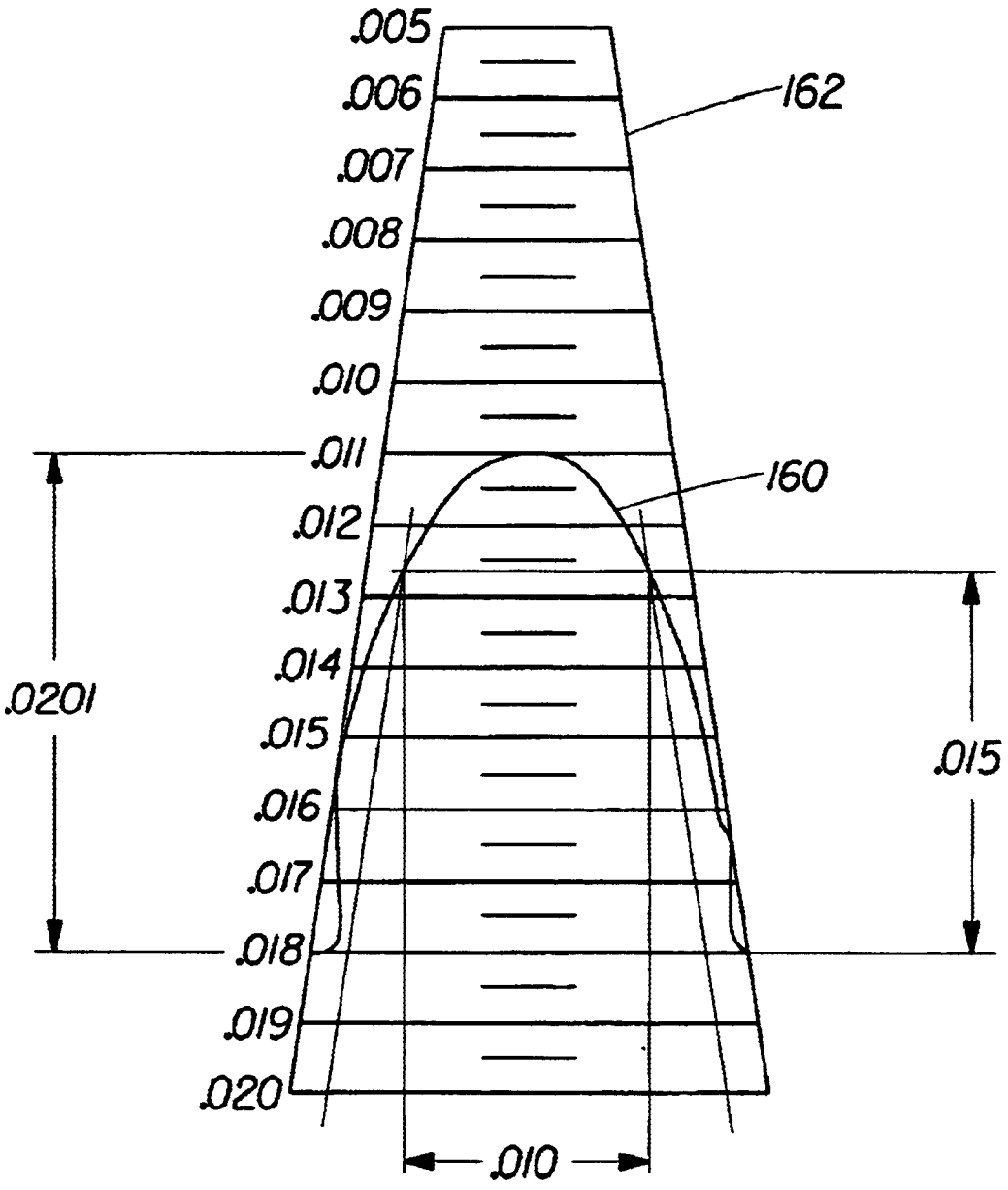
FIG. 14 illustrates a geometrical representation of the visual comparison of FIG. 13.

FIGS. 13 and 14 illustrate a cross-sectional impression 160 being compared to a template 162, wherein FIG. 13 illustrates the comparison against a light source, and FIG. 14 illustrates as a geometric drawing.

Figure 15:
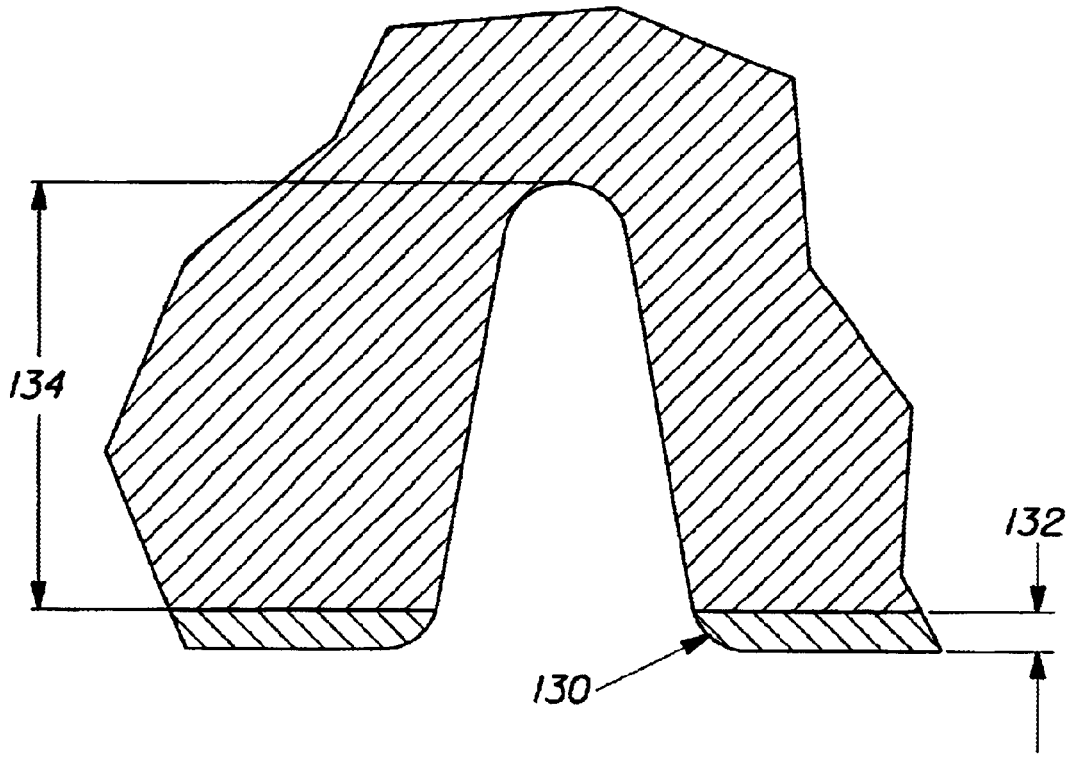
FIG. 15 illustrates a cross-sectional impression of a protrusion having unwanted radiuses targeted for removal.

The cross-sectional impressions can also provide information with respect to radiuses 130 on the peripheral surface of the rolls, as shown in FIG. 15, often resulting from laser burning. These radiuses can range generally between about 0.002" to about 0.004" (about 0.051 mm to about 0.102 mm). If the radiuses 130 are not desired for a particular pattern, the radiuses 130 can be removed by a subsequent machining of the peripheral surface of the roll, removing the outer material 132, as shown in FIG. 15. In such a case, the depth 134 of the burned recession can be burned appropriately deeper to accommodate the thickness of the removed outer material 132.

After the inspection of the test-burned areas of the embossing rolls 30 and 32 by use of the testing methods involving video microscope and cross-sectional impressions described herein above, the machining files can be modified by appropriately changing the operating parameters of the laser-burning to result in modified patterns that may be subsequently inspected and modified until the desired shapes and configurations of the impressions and/or recessions is achieved to provide a desired configuration of the corresponding recessions and protrusions and, as a result, a desired clearances between the respective protrusions and recessions during a full engagement position 49 (see FIGS. 2 and 8), described herein above. The modified machining files can be then used for laser-burning full embossing patterns of the first and second rolls 30 and 32, respectively.

Side Clearance Assessment of Embossing Patterns of Inter-engaged Pair of Rolls via Backlash Measurements The embossing patterns of the rolls 30 and 32 can then be inspected with respect to the backlash between inter-engaged embossing rolls, as a means to quantify the sidewall clearance 50—separating the inter-engaged, corresponding protrusions and recessions of the rolls 30 and 32—at a desired full radial engagement FRE of about 0.009" or about 0.229 mm at the full engagement position 49 described herein above (see also FIG. 8). The term "backlash" refers herein to a total circumferential displacement measured at an embossing roll's periphery (at a certain depth of radial engagement between the inter-engaged embossing rolls), which can occur when one embossing roll is rotated in a reciprocal manner and the opposing inter-engaged roll is preferably constrained from moving.

In such a test, the movable roll rotates in a first circumferential direction until any pattern element on the movable roll contacts an opposing pattern element on the constrained pattern roll. This position determines the reference, or zero, point. The movable roll is then rotated in the opposite circumferential direction until any pattern element on the movable roll contacts an opposing pattern element on the constrained pattern roll. The distance traveled from the reference position to this second position, on the periphery of the pattern roll, is the backlash at that circumferential position.

The backlash measurement can be obtained by using any suitable device known in the art, for example, dial indicators, micrometers, shaft mounted resolvers or encoders, which measure angular rotation, or any other suitable device known in the art. Since backlash measures the entire sidewall clearance between adjacent and opposing pattern elements, the backlash should be approximately double the target sidewall clearance described above since the sidewall clearance is defined as the desired open space on each side of a properly centered pattern element. However, not all elements on the movable roll will contact opposing elements at the same point since there is some variation in element position due to manufacturing tolerances, and since the embossing elements in the present example are relatively rigid, movement of the roll is restricted only by the first elements that meet each other. Therefore, such a test will actually quantify the minimum sidewall clearance at each measurement position of the inter-engaged rolls since the roll's displacement is limited by the first contact point. This methodology, therefore, determines the worst case for the sidewall clearance at each circumferential position at which it is taken.

This method of measuring backlash measures a relatively large portion of the elements on each pattern roll. As described above, the pattern used in the present example has a density of about 521 elements per 1 square inch (about 645 square mm), resulting in about 0.807 elements per 1 square mm or about 533 elements per the 660 mm of the width of the embossing pattern (in the cross-machine direction CMD). For the embossing rolls 30 and 32 having the outside diameters of about 610 mm and inter-engaged at a full radial engagement FRE of approximately 0.229 mm, approximately 8 additional rows of the embossing patterns (in the MD machine direction) will be also inter-engaged at smaller radial engagements (than the full radial engagement FRE of approximately 0.229 mm) of at least about 0.178 mm. Therefore, during each backlash measurement, the total number of inter-engaged elements (extending in both MD and CMD directions) will be approximately 4,797.

Once the measurement has been taken at a first circumferential position, the constrained roll is released, the rolls are rotated to the next desired circumferential position, and the measurement process is repeated. The successive measurements can be repeated in equal intervals around the circumference of the rolls. Registration between the embossing patterns of the rolls 30 and 32 can be maintained by manually rotating the rolls concurrently with the patterns inter-engaged.

In the present example, the backlash measurements were taken at 61 equally spaced positions around the circumference of the pattern rolls. With 4,797 embossing elements inter-engaged at each measurement position, a total of about 292,617 embossing elements on each roll are therefore included in 61 measurements taken around the circumferences of the rolls 30 and 32 (out of a total of approximately 1,020,180 embossing elements on each roll). The backlash data of the above 61 measurements is shown in the chart below:

| Data Point # | Backlash (mils) | Backlash (inches) | Backlash (mm) |
|---|---|---|---|
| 1 | 4.3 | 0.0043 | 0.10922 |
| 2 | 4.0 | 0.004 | 0.1016 |
| 3 | 4.0 | 0.004 | 0.1016 |
| 4 | 4.0 | 0.004 | 0.1016 |
| 5 | 4.0 | 0.004 | 0.1016 |
| 6 | 4.0 | 0.004 | 0.1016 |
| 7 | 3.5 | 0.0035 | 0.0889 |
| 8 | 4.6 | 0.0046 | 0.11684 |
| 9 | 4.0 | 0.004 | 0.1016 |
| 10 | 4.0 | 0.004 | 0.1016 |
| 11 | 3.8 | 0.0038 | 0.09652 |
| 12 | 3.5 | 0.0035 | 0.0889 |
| 13 | 4.0 | 0.004 | 0.1016 |
| 14 | 4.1 | 0.0041 | 0.10414 |
| 15 | 3.7 | 0.0037 | 0.09398 |
| 16 | 3.6 | 0.0036 | 0.09144 |
| 17 | 3.9 | 0.0039 | 0.09906 |
| 18 | 4.5 | 0.0045 | 0.1143 |
| 19 | 3.5 | 0.0035 | 0.0889 |
| 20 | 3.6 | 0.0036 | 0.09144 |
| 21 | 4.5 | 0.0045 | 0.1143 |
| 22 | 4.0 | 0.004 | 0.1016 |
| 23 | 3.8 | 0.0038 | 0.09652 |
| 24 | 4.1 | 0.0041 | 0.10414 |
| 25 | 3.5 | 0.0035 | 0.0889 |
| 26 | 3.8 | 0.0038 | 0.09652 |
| 27 | 3.5 | 0.0035 | 0.0889 |
| 28 | 4.3 | 0.0043 | 0.10922 |
| 29 | 4.4 | 0.0044 | 0.11176 |
| 30 | 4.1 | 0.0041 | 0.10414 |
| 31 | 4.3 | 0.0043 | 0.10922 |
| 32 | 4.1 | 0.0041 | 0.10414 |
| 33 | 4.5 | 0.0045 | 0.1143 |
| 34 | 4.0 | 0.004 | 0.1016 |
| 35 | 4.5 | 0.0045 | 0.1143 |
| 36 | 4.5 | 0.0045 | 0.1143 |
| 37 | 4.0 | 0.004 | 0.1016 |
| 38 | 4.5 | 0.0045 | 0.1143 |
| 39 | 3.7 | 0.0037 | 0.09398 |
| 40 | 3.6 | 0.0036 | 0.09144 |
| 41 | 4.5 | 0.0045 | 0.1143 |
| 42 | 4.6 | 0.0046 | 0.11684 |
| 43 | 4.3 | 0.0043 | 0.10922 |
| 44 | 4.2 | 0.0042 | 0.10668 |
| 45 | 4.5 | 0.0045 | 0.1143 |
| 46 | 4.6 | 0.0046 | 0.11684 |
| 47 | 4.6 | 0.0046 | 0.11684 |
| 48 | 4.6 | 0.0046 | 0.11684 |
| 49 | 5.0 | 0.005 | 0.127 |
| 50 | 4.5 | 0.0045 | 0.1143 |
| 51 | 4.4 | 0.0044 | 0.11176 |
| 52 | 4.2 | 0.0042 | 0.10668 |
| 53 | 4.5 | 0.0045 | 0.1143 |
| 54 | 4.3 | 0.0043 | 0.10922 |
| 55 | 4.6 | 0.0046 | 0.11684 |
| 56 | 4.6 | 0.0046 | 0.11684 |
| 57 | 4.5 | 0.0045 | 0.1143 |
| 58 | 4.8 | 0.0048 | 0.12192 |
| 59 | 3.8 | 0.0038 | 0.09652 |
| 60 | 4.8 | 0.0048 | 0.12192 |
| 61 | 5.0 | 0.005 | 0.127 |
| Backlash Mean (mm) | | | 0.106 |
| Backlash Standard Deviation (mm) | | | 0.010 |
| Minimum Clearance (mm) (Backlash Mean − 3 × Standard Deviation) | | | 0.076 |
| Maximum Clearance (mm) (Backlash Mean + 3 × Standard Deviation) | | | 0.136 |

From the above chart, the mean sidewall clearance for the 61 measurements is 0.106 mm and the standard deviation is 0.010 mm. Based on this data, the range of the backlash between the inter-engaged embossing elements of the rolls 30 and 32 can vary from about 0.076 mm to about 0.136 mm. This range is determined by subtracting three times the standard deviation (3×0.010 mm) from the mean sidewall clearance (0.106 mm) and adding three times the standard deviation to the mean sidewall clearance. Assuming a normal distribution of the data, the +/−three times the standard deviation covers 99.7% of the total population of about 1,020,180 embossing elements on each of the first and second embossing rolls 30 and 32. The 61 data points provide greater than 95% confidence that the data is an accurate representation of the actual clearance between 99% and 99.9% of all embossing elements on the rolls 30 and 32. These conclusions are based on the statistical methodology described in "Statistical Intervals", by Gerald H. Hahn and William Q. Meeker, Wiley, 1991, ISBN 0-471 88769-2. This reference is recognized in the art as an accurate methodology for evaluating intervals similar to clearances in mating patterns on embossing rolls as described herein.

The calculated backlash range of 0.076 mm to 0.136 mm described above compares favorably to the target sidewall clearance of 0.107 mm. The target sidewall clearance of 0.107 mm would have a corresponding backlash, or a total sidewall clearance, of 0.214 mm (two times the 0.107 mm sidewall clearance on each side of the properly centered embossing elements).

Since this backlash method measures the worst-case sidewall clearance, and the measured mean backlash (of about 0.106 mm, in the presented example), is approximately 50% of the target backlash (of about 0.214 mm, in the present example), it is apparent that novel capability of providing at least a pair of inter-engaged embossing rolls having a greater sidewall clearance than any conventional pair of embossing rolls (of about 0.025 mm) between the inter-engaged embossing elements, has been achieved.

Inspecting Embossed Web Material

For products used for food storage, the presence of pinholes can be a significant defect since the product's barrier properties to gaseous and liquid transmission can be substantially compromised. It has been found that this type of defect is significantly reduced by using the embossing rolls of the present invention. Therefore, the product manufactured during this test was then evaluated for pinhole defects. The defects were quantified according to the following method. A continuous portion of the embossed product comprising the full embossing width and a length corresponding to the circumference of the embossing rolls was placed on a white paper. A red ink marking pen was then used to apply red ink to the entire surface of the product sample while maintaining contact between the product sample and the white paper. The ink then transferred through any pinholes onto the white paper. The product sample was then removed from the paper and all red marks on the paper were counted. The defect count was then adjusted for a standard product area of about 72 square inches or about 46,452 square mm. The embossed material or wrap material 24 of the present invention, formed from the deformable material 22 such as HDPE film embossed with the embossing rolls 30 and 32 of the present invention as described above had a mathematical average of zero (0) pinholes per an about 72 square inch area (about 46,452 square mm) of the embossed material 24. (However, it has been found experimentally by the Applicants that the wrap material of the present invention can provide sufficient protective function when the number of pinholes does not exceed the mathematical average of 12 pinholes per an about 72 square inch area, about 46,452 square mm, of the embossed material 24).

The same test was previously performed on a wrap material made by a pair of conventional embossing rolls having matched, embossing patterns—provided by chrome plating the first roll prior to chemically etching the second roll and, thus, obtaining a sidewall clearance of about 0.001" (about 0.025 mm)—resulted in a substantially greater number of the mathematical average of pinholes, about 15.2 pinholes in about 72 square inch area (about 46,452 square mm) of the embossed material.

While particular embodiments and/or individual features of the present invention have been illustrated and described, it would be obvious to those skilled in the art that various other changes and modifications can be made without departing from the spirit and scope of the invention. Further, it should be apparent that all combinations of such embodiments and features are possible and can result in preferred executions of the invention. Therefore, the appended claims are intended to cover all such changes and modifications that are within the scope of this invention.

What is claimed is:

1. An apparatus for embossing a web material, comprising:

(a) a first embossing roll having a first embossing pattern engraved on at least a portion of the peripheral surface of the first roll, the first embossing pattern comprising protrusions and recessions; and (b) a second embossing roll having a second embossing pattern engraved on at least a portion of the peripheral surface of the second embossing roll, the second embossing pattern comprising protrusions and recessions, wherein the protrusions of the first embossing pattern of the first embossing roll become inter-engaged at a radial depth of engagement with the corresponding recessions of the second embossing pattern of the second embossing roll such that at least 99.7% of the inter-engaged protrusions and recessions are separated from each other by a sidewall clearance ranging from about 0.002" (about 0.050 mm) to about 0.050" (about 1.27 mm).

2. The apparatus of claim 1, wherein the sidewall clearance ranges from about 0.002" (about 0.050 mm) to about 0.008" (about 0.25 mm).

3. The apparatus of claim 2, wherein the radial depth of engagement is from about 0.005" or about 0.127 mm to about 0.010" or about 0.254 mm.

4. The apparatus of claim 1, wherein the protrusions of at least one of the embossing rolls have a width greater than about 0.002" or about 0.050 mm.

5. The apparatus of claim 1, wherein at least one of the embossing patterns is an amorphous pattern.

6. The apparatus of claim 1, wherein at least one of the embossing patterns has a pattern density ranging from about 10 to about 1,000 protrusions or recessions per a 1 square inch area or about 645 mm area of the embossing pattern.

7. The apparatus of claim 1, wherein the protrusions have sidewalls angled from about 0 degrees to about 30 degrees.

8. The apparatus of claim 7, wherein the angled sidewalls are configured to form rectilinear or curvilinear configurations, or any combination thereof.

9. The apparatus of claim 1, wherein the peripheral surface of at least one of the embossing rolls comprises a material selected from the group consisting of a metal, a plastic, a ceramic, and a rubber.

10. The apparatus of claim 1, wherein the protrusions of at least one of the embossing rolls are continuous or discrete.

11. The apparatus of claim 1, wherein the recessions of at least one of the embossing rolls are continuous or discrete.

12. The apparatus of claim 1, further comprising a third embossing roll inter-engaged with at least one of the first or the second embossing rolls.

* * * * *